US008175477B2

(12) United States Patent
Ishikawa

(10) Patent No.: US 8,175,477 B2
(45) Date of Patent: May 8, 2012

(54) IMAGE FORMING APPARATUS INCLUDING POSITION ADJUSTING MEMBER

(75) Inventor: Takatoshi Ishikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 391 days.

(21) Appl. No.: 12/533,217

(22) Filed: Jul. 31, 2009

(65) Prior Publication Data

US 2010/0215387 A1 Aug. 26, 2010

(30) Foreign Application Priority Data

Feb. 20, 2009 (JP) ..... 2009-037516

(51) Int. Cl.
*G03G 15/16* (2006.01)

(52) U.S. Cl. ..... 399/66; 399/121; 399/302; 399/45

(58) Field of Classification Search ..... 399/45, 399/66, 121, 302
See application file for complete search history.

(56) References Cited

U.S. PATENT DOCUMENTS

| | | | | |
|---|---|---|---|---|
| 2003/0223785 | A1 | 12/2003 | Kanekura et al. | |
| 2006/0170936 | A1* | 8/2006 | Takehara | 358/1.4 |
| 2008/0019717 | A1* | 1/2008 | Soshiroda | 399/45 |
| 2008/0279589 | A1 | 11/2008 | Muto et al. | |

FOREIGN PATENT DOCUMENTS

| | | |
|---|---|---|
| EP | 1298501 | 4/2003 |
| JP | 2000-293055 | 10/2000 |
| JP | 2004-078128 | 3/2004 |
| JP | 2004-102123 | 4/2004 |
| JP | 2004-133419 | 4/2004 |
| JP | 2007-033938 | 2/2007 |
| JP | 2008-281856 | 11/2008 |

* cited by examiner

*Primary Examiner* — David Gray
*Assistant Examiner* — G. M. Hyder
(74) *Attorney, Agent, or Firm* — Fildes & Outland, P.C.

(57) ABSTRACT

An image forming apparatus includes an image carrier, an endless intermediate transfer member having a transport surface and being tensioned to transport a developer image, transferred from the image carrier to the intermediate transfer member, from a first transfer position to a second transfer position, a first transfer member that brings the intermediate transfer member in contact with the image carrier and transfers a developer image present on the image carrier to the intermediate transfer member at the first transfer position, a second transfer member that transfers the developer image to a recording medium at the second transfer position, a position adjusting member that adjusts a position of the transport surface of the intermediate transfer member downstream of the first transfer position, and a controller that controls the position adjusting member responsively to a type of the recoding medium to which the second transfer member transfers the developer image.

5 Claims, 6 Drawing Sheets

FIG. 6

| | ITEM | UNIT | EXAMPLE | COMPARISON EXAMPLE |
|---|---|---|---|---|
| CONFIGU-RATION | TENSION OF INTERMEDIATE TRANSFER ELEMENT 50 | N | 35 | 35 |
| | LOAD IN NORMAL PRINT MODE | gf/cm | 13 | 13 |
| | LOAD IN SPECIAL PAPER PRINT MODE | gf/cm | 5 | 13 |
| | CONTROL FOR DECREASING LOAD | — | DISPLACE FIRST TENSION ROLLER 56 TO GO OFF IMAGE CARRIER 40 | NO PROVIDED |
| | MOVABLE DISTANCE OF FIRST TENSION ROLLER 56 | mm | 3 | — |
| | MOVABLE DISTANCE OF SECOND TENSION ROLLER 58 | mm | 5 | — |
| | CHANGE IN DIRECTION (ANGLE) IN WHICH INTERMEDIATE TRANSFER ELEMENT 50 IS SUSPENDED | DEGREES | 3 | NO CHANGE |
| EVALU-ATION | TRANSFER PERFORMANCE TO EMBOSSED PAPER | | GOOD | PARTIALLY INSUFFICIENT |
| | IMPERFECT PRINT IN CENTER AREA FOR EMBOSSED PAPER | | GOOD | IMPERFECT PRINT IN CENTER AREA OCCURS |
| | IMPERFECT PRINT IN CENTER AREA FOR COATED PAPER | | GOOD | IMPERFECT PRINT IN CENTER AREA OCCURS |

IMAGE FORMING APPARATUS INCLUDING POSITION ADJUSTING MEMBER

CROSS-REFERENCE TO RELATED APPLICATIONS

This application is based on and claims priority under 35 USC 119 from Japanese Patent Application No. 2009-037516 filed Feb. 20, 2009.

BACKGROUND

Technical Field

The present invention relates to an image forming apparatus.

SUMMARY

According to an aspect of the invention, there is provided an image forming apparatus including an image carrier, an endless intermediate transfer member having a transport surface and being tensioned to transport a developer image, transferred from the image carrier to the intermediate transfer member, from a first transfer position to a second transfer position, a first transfer member that brings the intermediate transfer member in contact with the image carrier and transfers a developer image present on the image carrier to the intermediate transfer member at the first transfer position, a second transfer member that transfers the developer image to a recording medium at the second transfer position, a position adjusting member that adjusts a position of the transport surface of the intermediate transfer member downstream of the first transfer position, and a controller that controls the position adjusting member responsively to a type of the recoding medium to which the second transfer member transfers the developer image.

BRIEF DESCRIPTION OF THE DRAWINGS

An exemplary embodiment of the present invention will be described in detail based on the following figures, wherein:

FIG. 6 is a table tabulating evaluation results of second transfer of developer images carried out by an example of the image forming apparatus according to the exemplary embodiment of the invention and by a comparison example.

DETAILED DESCRIPTION

In the following, an exemplary embodiment of the present invention will be described, based on the drawings.

Figure 1:
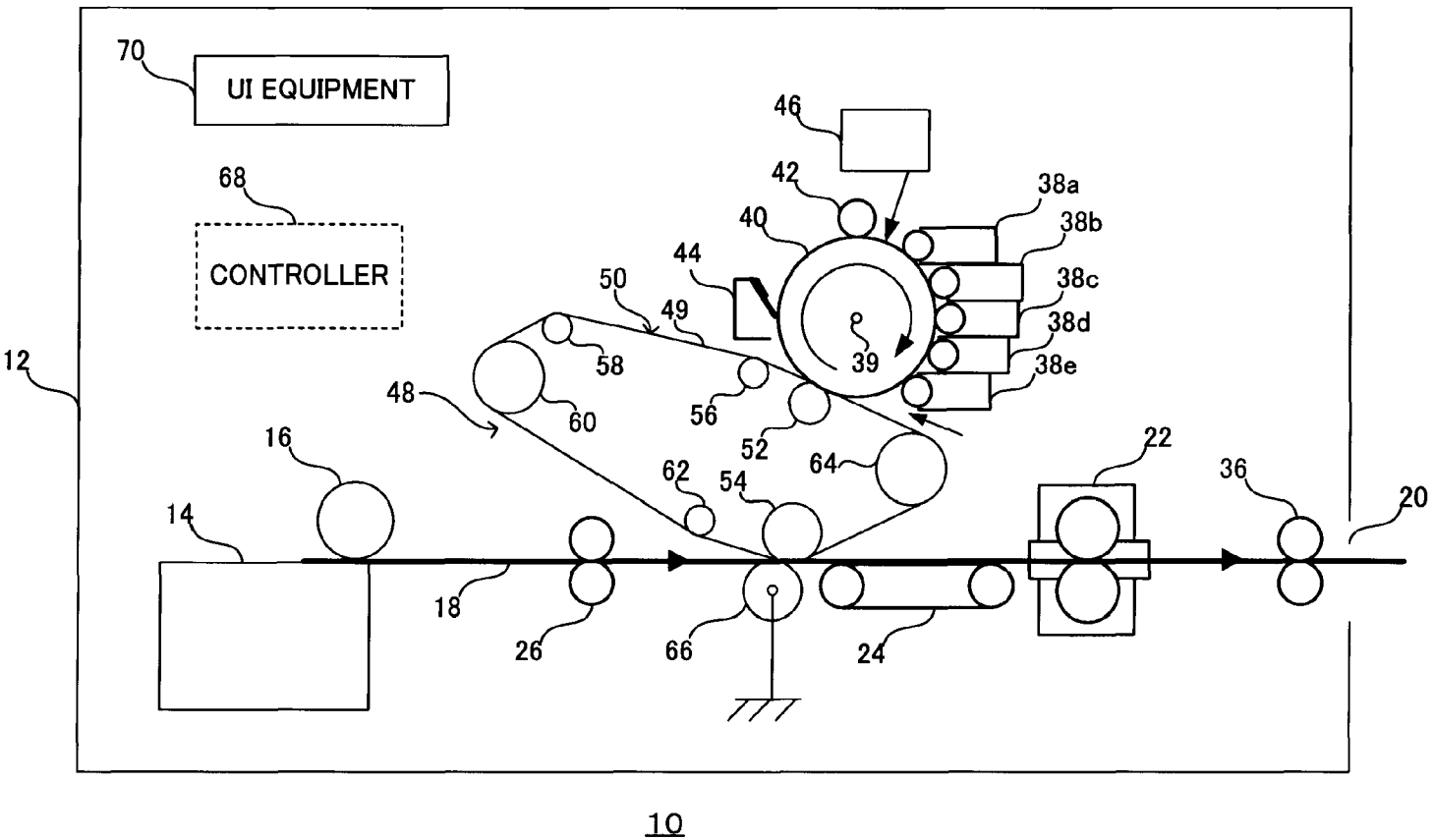
FIG. 1 is a side view depicting an overview of an image forming apparatus according to an exemplary embodiment of the invention.

FIG. 1 depicts an overview of an image forming apparatus 10 according to an exemplary embodiment of the invention. The image forming apparatus 10 has an image forming apparatus main body 12 and a paper feed unit 14 which may have, for example, a single tray disposed in the rear portion (left in FIG. 1) of the image forming apparatus main body 12.

The paper feed unit 14 is configured such that it can contain and feed different types of recording media such as special paper, for example, embossed paper having a convexo-concave surface and coated paper with smoother surface roughness, as well as plain paper. A pickup roller 16 is disposed at the top of the paper feed unit 14 to pick up a recording medium from the paper feed unit 14. The pickup roller 16 is driven by a driving mechanism which is not shown and rotates to feed a recording medium toward a transport path 18.

The transport path 18 is the passage for a recording medium from the pickup roller 16 to an ejection port 20. The transport path 18 runs through approximately the middle of the image forming apparatus main body 12 and is formed to extend substantially horizontally from the paper feed unit 14 to the ejection port 20. Along the transport path 18, upward of a fixing device 22, a transport part 24 and a second transfer roller 66 and a second transfer backup roller 54 which will be described later are disposed. Upstream of the second transfer roller 66 and the second transfer backup roller 54, registration rollers 26 are disposed. Eject rollers 36 are disposed in proximity to the ejection port 20 of the transport path 18.

Thus, a recording medium picked up by the pickup roller 16 from the paper feed unit 14 is guided to the transport path 18 and temporarily stopped by the registration rollers 26 for timing adjustment. When the recording medium passes between the second transfer roller 66 and the second transfer backup roller 54 to be described later, a developer image is transferred to it. Then, the recording medium is transported by the transport part 24 to the fixing device 22 where the developer image is fixed onto the medium which is in turn ejected from the ejection port 20 by the eject rollers 36.

In the image forming apparatus main body 12, development devices 38*a* to 38*e* are disposed, for example, in an upper section approximately in the middle of the main body. The development devices 38*a* to 38*e* respectively contain five kinds of toners (developers) clear (transparent: L), yellow, magenta, cyan, and black. The development devices 38*a* to 38*e* develop an electrostatic latent image present on an image carrier 40 to be described later, using their respective developers.

The development devices 38*a* to 38*e* and the image carrier 40 made of a photoreceptor that rotates about, for example, a rotating shaft 39, are disposed so that the image carrier 40 comes in contact with the development devices 38*a* to 38*e* from the rear side of the image forming apparatus 10. On the top of the image carrier 40, a charging device 42 is provided which is formed of, for example, a charging roller to uniformly charge the image carrier 40. Thus, a development bias is applied to the image carrier 40. Also, an image carrier cleaner 44 is placed in contact with the image carrier 40 upstream of the charging device 42 in the direction of rotation of the image carrier 40. The image carrier cleaner 44 scrapes away developer particles remaining on the image carrier 40, for example, after first transfer.

Above the image carrier 40, an optical writing device 46 is disposed that forms an electrostatic latent image on the image carrier 40 charged by the charging device 42 by using a beam such as a laser beam. Under the image carrier 40, an intermediate transfer device 48 transports a developer image developed by the development devices 38*a* to 38*e*, the developer image being first-transferred in a first transfer position, to a second transfer position to be described later.

The intermediate transfer device 48 is composed of an intermediate transfer element 50 which is, for example, an endless intermediate transfer belt having a transport surface 49 to transport a developer image, a first transfer roller 52, a second transfer backup roller (second transfer auxiliary roller) 54 that faces and abuts the second transfer roller 66 to be described later in the second transfer position and supports the intermediate transfer element 50, a first tension roller 56, a second tension roller 58, a third tension roller 60, a fourth tension roller 62, and a driving roller 64. The intermediate transfer element 50 to which the developer images on the image carrier 40 are transferred overlayingly in order, for example, clear, yellow, magenta, cyan, and black by the first transfer roller 52 in the first transfer position turns in a tensioned state to transport the first-transferred developer image toward the second transfer roller 66.

Abutting the second transfer backup roller 54 of the intermediate transfer device 48, the second transfer roller 66 is disposed across the transport path 18. That is, there is the second transfer position between the second transfer roller 66 and the second transfer backup roller 54. The second transfer roller 66 is brought in press contact with the intermediate transfer element 50 with the aid of the second transfer backup roller 54 and the developer image first-transferred to the intermediate transfer element 50 is second-transferred to a recording medium in the second transfer position by contact force and electrostatic force. Here, arrangement is made such that, during four turns of the intermediate transfer element 50 to transport four kinds of developer images, i.e., clear, yellow, magenta, and cyan, the second transfer roller 66 stays off the intermediate transfer element 50 and is brought in press contact with the intermediate transfer element 50 only after a black developer image is transferred.

Along the transport path 18, downstream of the second transfer position, the fixing device 22 is disposed. The fixing device 22 includes a heating roller and a pressure roller and fixes a developer image second-transferred to a recoding medium by the second transfer roller 66 and the second transfer backup roller 54 onto the recording medium and further transports the medium.

Inside the image forming apparatus 10, a controller 68 is provided to control all components constituting the image forming apparatus 10. The image forming apparatus 10 is also provided with user interface (UI) equipment 70 such as, for example, a touch panel to receive a setting command input to the image forming apparatus 10. The UI equipment 70 receives, for example, a setting command to select either a special paper print mode in which an image is printed on special paper such as embossed paper or coated paper contained in the paper feed unit 14 or a normal print mode in which an image is printed on any other recording medium contained in the paper feed unit 14 and outputs the setting command to the controller 68.

Then, the intermediate transfer device 48 is described in greater detail.

Figure 2:
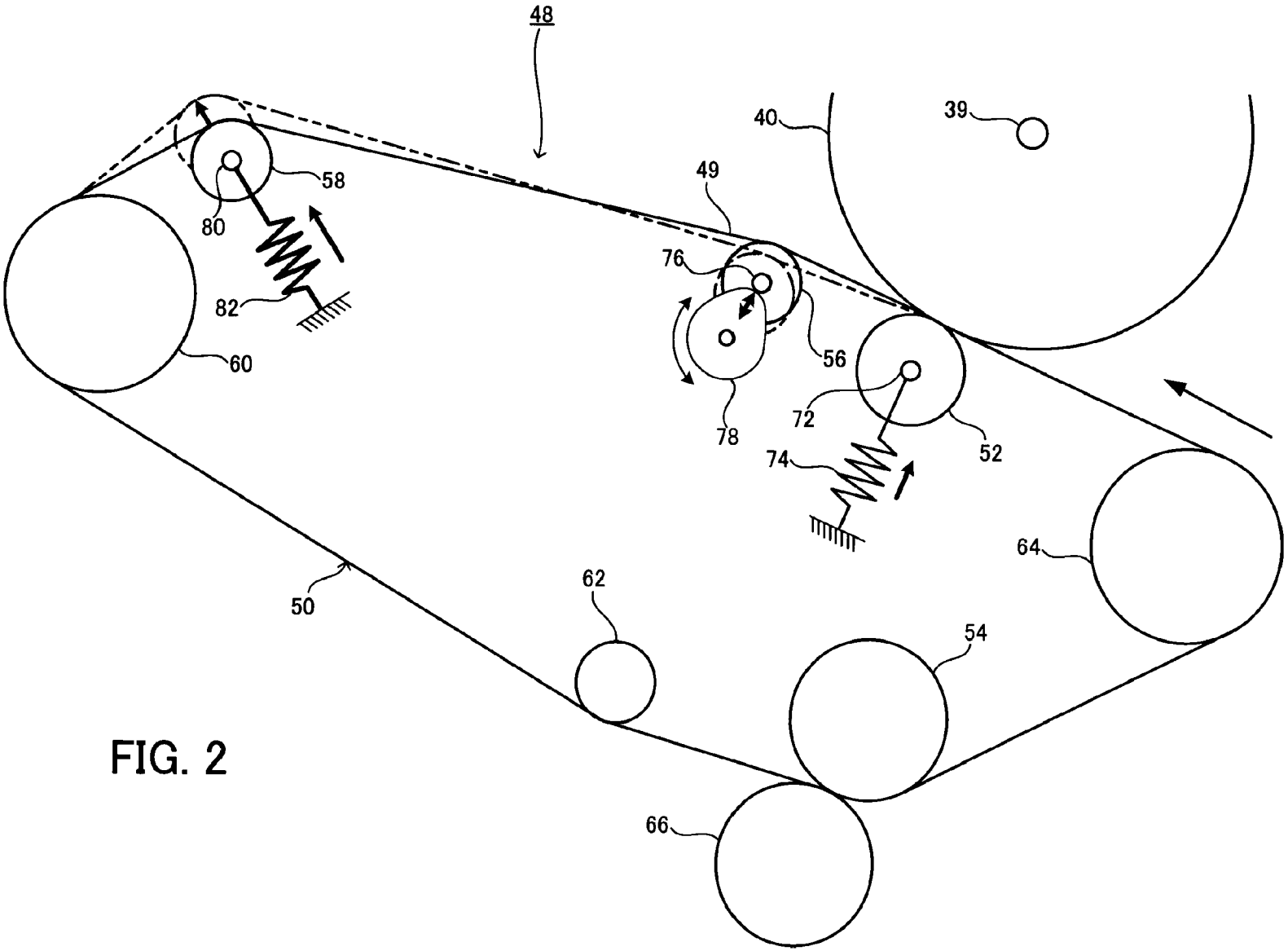
FIG. 2 is an enlarged view depicting details of an intermediate transfer device and its periphery.

FIG. 2 is an enlarged view depicting details of the intermediate transfer device 48 and its periphery. The intermediate transfer device 48 is configured such that the first transfer roller 52, the first tension roller 56, and the second tension roller 58 are displaceable and the second transfer backup roller 54, the third tension roller 60, the fourth tension roller 62, and the driving roller 64 rotate about their fixed rotating shafts.

The first transfer roller 52 rotates about its rotating shaft 72 and, by urging the rotating shaft 72 by means of an urging member 74 such as a spring, it brings the intermediate transfer element 50 in press contact with the image carrier 40, so that a developer image present on the image carrier 40 is first-transferred to the intermediate transfer element 50. The urging member 74 is adapted to urge the first transfer roller 52 toward the image carrier 40 so that the first transfer roller 52 can be displaced in response to a displacement of the first tension roller 56.

The first tension roller 56 is provided with, e.g., a cam 78 in contact with its rotating shaft 76 and is displaced in a predetermined direction by the rotation of the cam 78 which is driven by a driving mechanism which is not shown under control of the controller 68. The rotating shaft 80 of the second tension roller 58 is urged by an urging member 82 such as a spring. When the first tension roller 56 is displaced, the second tension roller 58 is displaced to a larger extent than the first tension roller 56, so that predetermined tension applied to the intermediate transfer element 50 is maintained.

Figure 3:
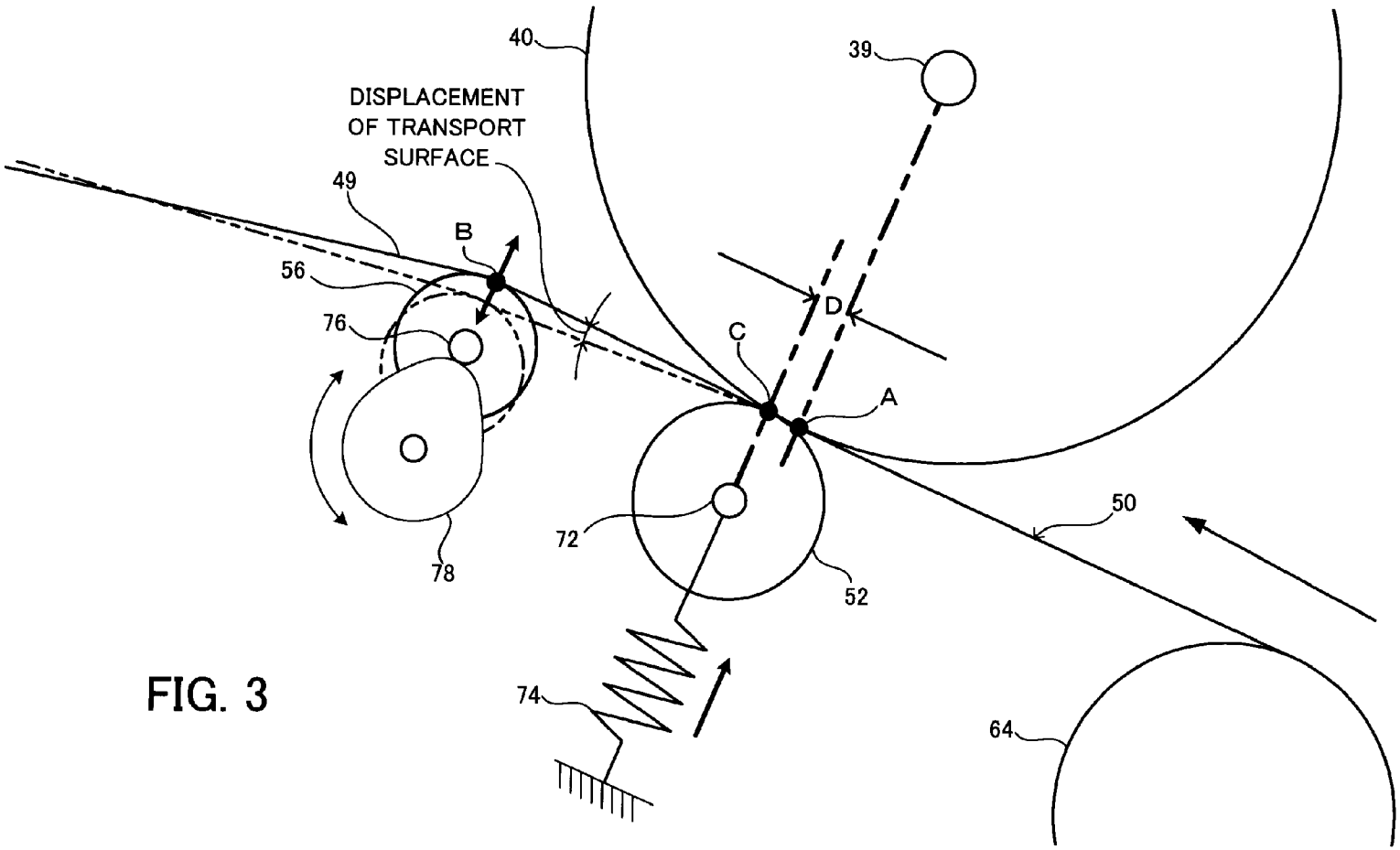
FIG. 3 is an enlarged view depicting a relationship between the displacement of a first tension roller and the state of an intermediate transfer element in a first transfer position.

FIG. 3 is an enlarged view depicting a relationship between the displacement of the first tension roller 56 and the state of the intermediate transfer element 50 in the first transfer position.

The first transfer roller 52 is positioned so as to contact the intermediate transfer element 50 around a position C. The position C is downstream in the direction of rotation of the intermediate transfer element 50 (downstream in the direction of transporting developer images) relative to a position A where the transport surface 49 of the intermediate transfer element 50 contacts the image carrier 40, the position A being the most upstream in the direction of rotation of the intermediate transfer element 50. However, the position C is upstream in the direction of rotation of the intermediate transfer element 50 (upstream in the direction of transporting developer images) relative to a position B where the first tension roller 56 contacts the intermediate transfer element 50. As is shown in FIG. 3, there is provided, for example, a distance D between the most upstream position A where the intermediate transfer element 50 contacts image carrier 40 and the position C where the first transfer roller 52 contacts the intermediate transfer element 50.

A surface region having a predetermined width of the first transfer roller 52 is pressed against the image carrier 40 across the intermediate transfer element 50.

In a case where, for example, the normal print mode is set via the UI equipment 70, the first tension roller 56 is moved upward by the cam 78, as indicated by a solid line in FIG. 3. Due to this, the intermediate transfer element 50 suspended in a tensioned state becomes closer to the image carrier 40 downstream of the position C.

When the first tension roller 56 is moved up by the cam 78, the intermediate transfer element 50 suspended by the first tension roller 56 also moves up (the suspension direction from the position C ascends). This increases the contact force by which the intermediate transfer element 50 press-contacts the developer image between the first transfer roller 52 and the image carrier 40.

In a case where, for example, the special paper print mode is set via the UI equipment 70, the first tension roller 56 is moved down by the cam 78. As indicated by a two-dot chain line in FIG. 3, the intermediate transfer element 50 suspended in a tensioned state moves to go off the image carrier 40.

When the first tension roller 56 is moved down and the intermediate transfer element 50 suspended by the first tension roller 56 moves down (the suspension direction from the position C descends), the contact force by which the intermediate transfer element 50 press-contacts the developer image between the first transfer roller 52 and the image carrier 40 decreases accordingly. The contact width between the intermediate transfer element 50 and first transfer roller 52 is defined to be approximately constant, independent of the displacement of the first tension roller 56. Displacement of the first tension roller 56 to a lower position narrows the width of the region of the surface of the first transfer roller 52 being pressed against the image carrier 40 across the intermediate transfer element 50.

The first tension roller 56 is thus displaceable to adjust the direction (angle) in which the intermediate transfer element 50 is suspended in a tensioned state from the first transfer position. The first tension roller 56 suspends the intermediate transfer element 50 to adjust the contact force by which the intermediate transfer element 50 press-contacts a developer image present on the image carrier 40 to a predetermined level of force. In other words, the first tension roller 56 acts as a position adjusting roller to adjust the position of the transport surface 49 of the intermediate transfer element 50 downstream of the first transfer position.

When the first tension roller 56 is displaced to a lower position by the cam 78, the second tension roller 58 is moved outward by the urging force of the urging member 82, as shown in FIG. 2, so that the tension of the intermediate transfer element 50 is maintained (adjusted). In other words, the second tension roller 58 acts as a tension adjusting roller which makes an adjustment to maintain the tension of the intermediate transfer element 50.

As described above, the urging member 74 urges the first transfer roller 52 toward the image carrier 40 to allow the first transfer roller 52 to displace in response to the first tension roller 56. Accordingly, when the first tension roller 56 displaces to a lower position while the tension of the intermediate transfer element 50 is maintained, the intermediate transfer element 50 exerts pressure on the first transfer roller 52 downward.

Figure 4A:
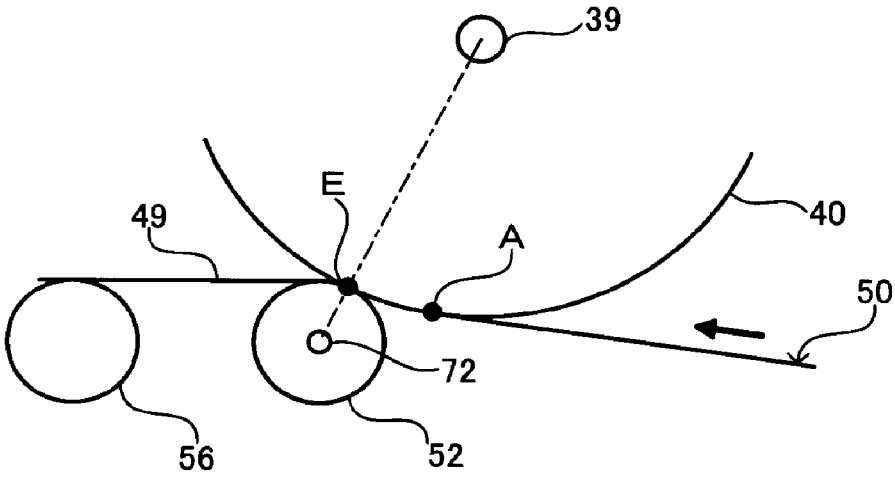
FIG. 4A schematically illustrates the states of the first transfer roller and the intermediate transfer element with respect to the image carrier in a normal print mode.
Figure 4B:
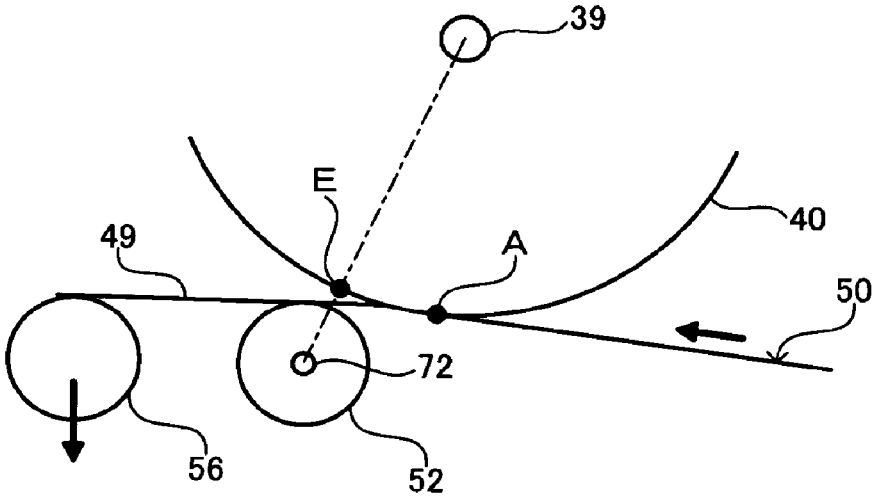
FIG. 4B schematically illustrates the states of the first transfer roller and the intermediate transfer element with respect to the image carrier in a special paper print mode.

As compared to the positions of the first transfer roller 52 and the intermediate transfer element 50 with respect to the image carrier 40 in the normal print mode, for example, illustrated in FIG. 4A, the first transfer roller 52 and the intermediate transfer element 50 (transport surface 49) displace to a lower position (to go off the image carrier 40) due to the downward displacement of the first tension roller 56, downstream in the direction of rotation of the intermediate transfer element 50 (downstream in the direction of transporting developer images) relative to the most upstream position A in the direction of transporting developer images, where the transport surface 49 contacts with the image carrier 40, in the special paper print mode, as illustrated in FIG. 4B.

In other words, the first tension roller 56 acts as a pressure adjusting roller to adjust the pressure by which the first transfer roller 52 brings the intermediate transfer element 50 into contact with the image carrier 40.

In both of the normal print mode and the special paper print mode, the first transfer roller 52 is located such that a point E at which a straight line (segment) from the rotating shaft 39 to the rotating shaft 72 intersects with the outer surface of the image carrier 40 is positioned downstream relative to the position A in the direction of transporting developer images.

In a case where a developer image is second-transferred to a recording medium having a convexo-concave surface like embossed paper, the electrostatic force to attract a developer for second transfer in concaves of embossed paper is to be weaker than the electrostatic force to attract a developer for second transfer in convexes and the like of embossed paper.

In fact, by decreasing the contact force for press contact between a developer image present on the image carrier 40 and the intermediate transfer element 50 to a predetermined level of force, the developer becomes more likely to be transferred from the intermediate transfer element 50 to a recording medium, even if the electrostatic force to attract the developer for second transfer is weakened.

Figure 5:
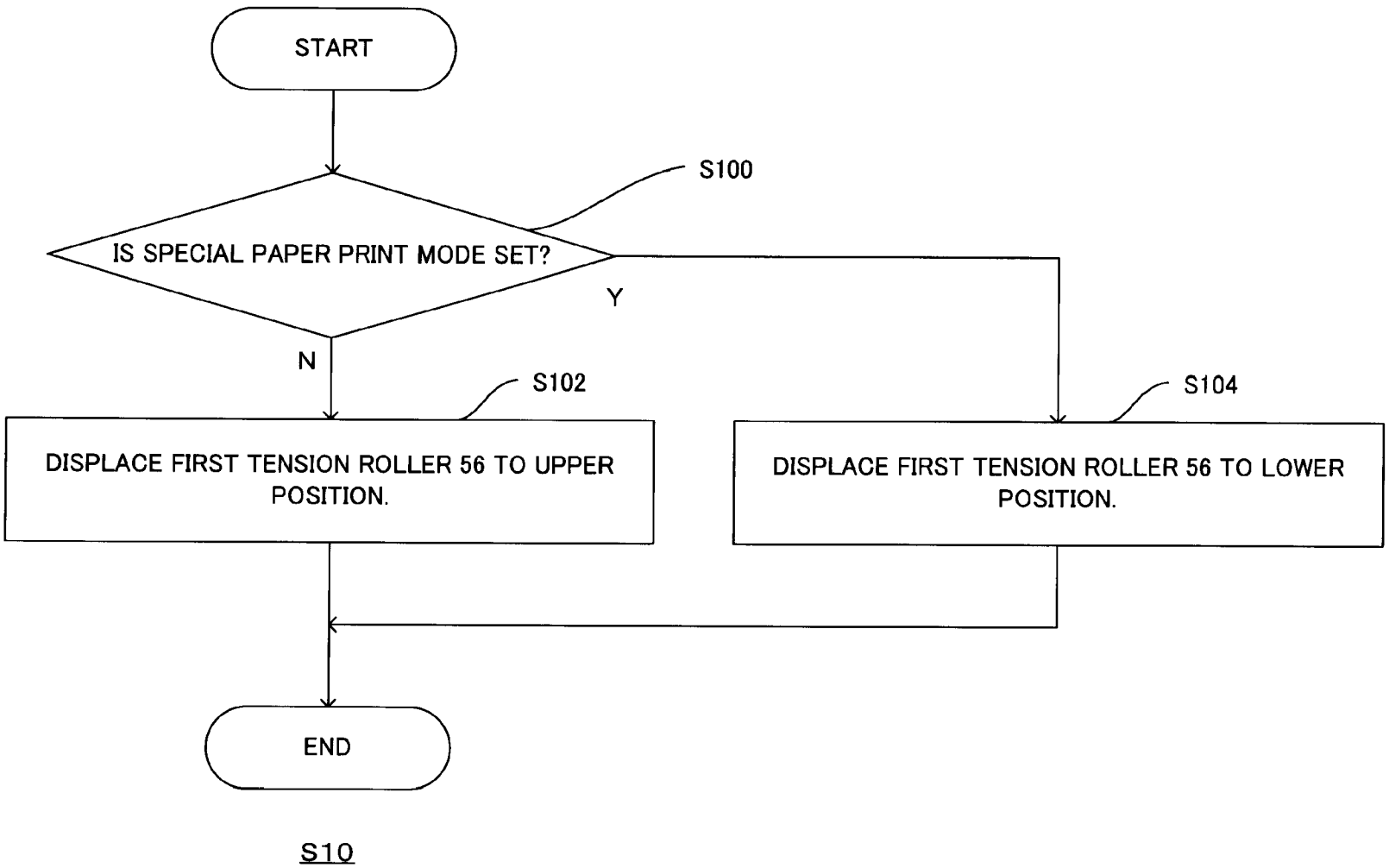
FIG. 5 is a flowchart illustrating a process (S10) for controlling the displacement of the first tension roller by the controller.

FIG. 5 is a flowchart illustrating a process (S10) for controlling the displacement of the first tension roller 56 by the controller 68.

As illustrated in FIG. 5, at step 100 (S100), the controller 68 determines whether the special paper print mode is set, for example, via the UI equipment 70. If not, the process goes to step S102; if so, the process goes to step S104.

At step 102 (S102), the controller 68 displaces the first tension roller 56 to an upper position via the cam 78.

At step 104 (S104), the controller 68 displaces the first tension roller 56 to a lower position via the cam 78.

Next, results of second transfer of developer images carried out by an example of the image forming apparatus 10 according to the exemplary embodiment of the invention and by a comparison example are discussed.

FIG. 6 is a table tabulating evaluation results of second transfer of developer images carried out by an example of the image forming apparatus 10 according to the exemplary embodiment of the invention and by a comparison example.

As presented in FIG. 6, the image forming apparatus 10 is configured such that the tension of the intermediate transfer element 50 is maintained at 35N. The image forming apparatus 10 is also configured such that a load of 13 gf/cm is applied to a developer image which is first-transferred to the intermediate transfer element 50 when in the normal print mode. Further, the image forming apparatus 10 is configured such that a load of 5 gf/cm is applied to a developer image which is first-transferred to the intermediate transfer element 50 by displacing the first tension roller 56 to go off the image carrier 40 when in the special paper print mode.

When the first tension roller 56 is moved down by the cam 78, the height of the intermediate transfer element 50 at the point suspended by the first tension roller 56 moves down by, for example, 3 mm. Further, the following is assumed: when the first tension roller 56 makes a displacement of 3 mm, the second tension roller 58 makes a displacement of, for example, 5 mm, and the direction in which the intermediate transfer element 50 is suspended from the position C (see FIG. 4) changes by three degrees.

The image forming apparatus 10 is configured as in the example presented in FIG. 6 and it is assumed that the special paper print mode is set. The performance of the apparatus 10 is evaluated in terms of: for example, transfer performance to embossed paper (degree of transfer of whole developer images), degree of occurrence of imperfect print in a center area (print condition in which density in a center area is lower than density in both end portions of a continuous image in fast-scanning direction) for embossed paper, and degree of occurrence of imperfect print in a center area for coated paper. From the results of the evaluations, it is recognized that good second transfer is performed to a level without visually perceivable problems.

On the other hand, an image forming apparatus of a comparison example is not provided with a mechanism for controlling the load applied to a developer image. In both of the normal print mode and the special paper print mode, a load of 13 gf/cm is assumed to be applied to a developer image which is first-transferred to the intermediate transfer element 50.

The performance of the image forming apparatus of the comparison example is also evaluated in terms of: transfer performance to embossed paper, degree of occurrence of imperfect print in a center area for embossed paper, and degree of occurrence of imperfect print in a center area for coated paper. From the results of the evaluations, it is found that second transfer results in partially insufficient transfer to embossed paper and occurrence of imperfect print in a center area for embossed paper and coated paper.

The present invention may be embodied in other specific forms without departing from its spirit or characteristics. The described exemplary embodiment is to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. An image forming apparatus comprising:

an image carrier respectively holding a plurality of colors of developer images;

an endless intermediate transfer member having a transport surface and being tensioned to transport the developer images, transferred from the image carrier to the intermediate transfer member, from a first transfer position to a second transfer position;

a first transfer member that brings the intermediate transfer member in contact with the image carrier and transfers overlayingly a plurality of colors of the developer images present on the image carrier to the intermediate transfer member at the first transfer position;

a second transfer member that transfers the developer images to a recording medium at the second transfer position by electrostatic force;

a position adjusting member that adjusts a position of the transport surface of the intermediate transfer member downstream of the first transfer position so as to adjust pressure applied by the first transfer member to the intermediate transfer member to bring the intermediate transfer member in contact with the image carrier; and a controller that controls the position adjusting member based on information it receives concerning a type of the recoding medium to which the second transfer member is to transfer the developer images.

2. The image forming apparatus according to claim 1, wherein the controller controls the position adjusting member by decreasing pressure applied by the first transfer member to the intermediate transfer member to bring the intermediate transfer member in contact with the image carrier in a case in which the developer images are second-transferred to a recording medium having a convexo-concave surface.

3. The image forming apparatus according to claim 1, further comprising an urging member that urges the first transfer member toward the image carrier so that the first transfer member is displaced in response to a displacement of the position adjusting member.

4. The image forming apparatus according to claim 1, wherein the image carrier rotates about a first rotating shaft;

the first transfer member rotates about a second rotating shaft; and the first transfer member is located such that a point at which a straight line from the first rotating shaft to the second rotating shaft intersects with an outer surface of the image carrier is positioned downstream relative to the most upstream position where the transport surface of the intermediate transfer member contacts the image carrier in a direction of transporting the developer images.

5. The image forming apparatus according to claim 1, further comprising a tension adjusting member that adjusts tension of the intermediate transfer member when the controller controls the position adjusting member.

* * * * *